US010426280B2

(12) United States Patent
Cross

(10) Patent No.: US 10,426,280 B2
(45) Date of Patent: Oct. 1, 2019

(54) MULTIFUNCTIONAL UNIVERSAL SILICON SPOUT ADAPTOR FOR DRINKING VESSELS

(71) Applicant: James Richard Cross, Melbourne (AU)

(72) Inventor: James Richard Cross, Melbourne (AU)

( * ) Notice: Subject to any disclaimer, the term of this patent is extended or adjusted under 35 U.S.C. 154(b) by 190 days.

(21) Appl. No.: 15/679,211

(22) Filed: Aug. 17, 2017

(65) Prior Publication Data

US 2018/0064272 A1 Mar. 8, 2018

Related U.S. Application Data

(60) Provisional application No. 62/382,793, filed on Sep. 2, 2016.

(51) Int. Cl.

| | |
|---|---|
| ***A47G 19/22*** | (2006.01) |
| ***A47G 19/30*** | (2006.01) |
| *B65D 43/02* | (2006.01) |
| *A61J 11/04* | (2006.01) |
| *A47G 21/18* | (2006.01) |

(52) U.S. Cl.

CPC ..... *A47G 19/2272* (2013.01); *A47G 19/2266* (2013.01); *A47G 19/30* (2013.01); *A47G 21/185* (2013.01); *A61J 11/04* (2013.01); *B65D 43/02* (2013.01)

(58) Field of Classification Search

None

See application file for complete search history.

(56) References Cited

U.S. PATENT DOCUMENTS

| | | | | |
|---|---|---|---|---|
| 4,901,881 | A * | 2/1990 | McElroy | B65D 41/22 215/229 |
| 4,940,152 | A | 7/1990 | Lin | |
| 6,394,319 | B1 | 5/2002 | Pucillo | |
| 7,318,534 | B2 * | 1/2008 | Turvey | B65D 25/16 220/287 |
| 8,376,165 | B2 | 2/2013 | Chiang | |
| 9,232,870 | B2 | 1/2016 | Wang | |
| 2011/0062168 | A1 | 3/2011 | Chow | |
| 2012/0067910 | A1 * | 3/2012 | Chun | A47G 19/2266 220/709 |
| 2014/0163463 | A1 | 6/2014 | Agbo | |
| 2016/0262558 | A1 * | 9/2016 | Beck, Jr. | A47G 19/2272 |
| 2018/0317684 | A1 * | 11/2018 | Hung | B65D 25/16 |

FOREIGN PATENT DOCUMENTS

| | | |
|---|---|---|
| CA | 2823027 | 2/2015 |
| CN | 204910141 U | 12/2015 |

* cited by examiner

*Primary Examiner* — Sarah B McPartlin

(57) ABSTRACT

A multi-purpose stretchable insert-mounting lid comprises a stretchable hollow body and a rigid ring member. The stretchable hollow body comprises a top opening, a bottom opening and a flexible sidewall. The flexible sidewall is configured to extend over sidewalls of a receptacle of one or more sizes. The top opening is configured to conform to an outlet of the receptacle. The rigid ring member is fixedly attached to an inner surface of the stretchable hollow body proximal to the top opening of the stretchable hollow body. Further, the rigid ring member is configured to restrain the stretchable hollow body against the receptacle. The rigid ring member comprises attachment elements configured to mount one or more insert elements for dispensing contents of the receptacle via the outlet.

6 Claims, 7 Drawing Sheets

MULTIFUNCTIONAL UNIVERSAL SILICON SPOUT ADAPTOR FOR DRINKING VESSELS

RELATED APPLICATION DATA

This application claims the priority to U.S. Provisional Application No. 62/382,793 filed on Sep. 2, 2016, which is hereby incorporated by reference in its entirety.

TECHNICAL FIELD

The present invention generally relates to lids for diverse types of containers/vessels. More particularly, the invention, disclosed herein, relates to a universal lid that allows diverse types of inserts, for example, nipples, straw tubes, sippy tubes, to be mounted. Additionally, the invention relates to a universal lid that can be extended over diverse types of containers/receptacles.

BACKGROUND

Feeding infants is a round-the-clock commitment that must be carried out with care. Although breast-feeding babies is the best method, it is not feasible when in public or when the mother is not around. In such cases, alternate methods, such as the use of feeding bottles containing milk or other infant formula food is widely accepted. Currently parents are required to buy specialized drinking vessels for their baby in various forms, for example, a baby bottle with nipple insert, a bottle with a sippy spout or a straw spout for when the baby teaches toddler stage, etc. The problem with this is that each vessel has a limited life span. It is common that after 9 months of age the baby will no longer require a baby bottle with a nipple as the baby has progressed to the next stage of feeding. This means the baby bottle is of no use to the parent anymore. Furthermore, the parent usually needs to purchase many baby bottles to meet the demands of feeding a baby. Such a situation results in a lot of waste once the period is reached where the baby bottle is no longer needed and is therefore often discarded. Moreover, the parents when travelling are required to not only carry drinking vessels they may need for themselves, but also the special drinking vessels they need for baby such as the baby bottles and sippy cups. This results in a cumbersome travelling experience, especially when the baby is transitioning from milk in a baby bottle to liquids in a sippy cup, in which case numerous types of baby and toddler drinking vessels are required.

Whilst there are currently silicone spout adaptors on the market that turn an adult drinking vessel into a toddler sippy or straw cup, these existing adaptors can only perform a single function as the drinking spout component is built into the device. This means the user will need to purchase multiple spout adaptors for the diverse needs of the child. For instance, the user will need to buy a silicone sippy spout adaptor, a separate silicone straw cup adaptor and so on. Just like it is cumbersome to travel with many bottles, it is also cumbersome to travel with many adaptors to convert existing drinking vessels. It is commonly known that babies can be very fussy with the nipple that they use on a baby bottle and at times they will not feed from the nipple that came with the baby bottle. To combat this issue, there are varied brands of baby bottles on the market that use a "universal" size of nipple for wide neck bottles. By creating the nipple at a universal it means the parents can try distinct brands of baby brand nipples on their compatible bottle, in the case that their baby is not taking to the brand of nipple that came with the compatible bottle. However, there is no silicone adaptor on the market that currently allows a parent to use varied brands of nipples or out spout inserts. In fact, there is no other silicone adaptor on the market that allows for inserts.

The choice of silicone feeding bottles over conventional plastic feeding bottles has become a recent preference of safety concerned parents. Besides being Bisphenol-A free (BPA-free), silicone is flexible, can be safely heated, is dishwasher safe, and provides high spill proof resistance. While it is true that this advancement has nailed many drawbacks associated with conventional feeding bottles, nonetheless, one dire need of having a main-purpose feeding solution which can conveniently be reused per se with other associated components, adapted for different age groups of children with different feeding requirements is something that is yet to be achieved. In other words, not every feeding container serves multiple purposes. Requirements of an infant or a weaned breast-feeding infant are very different from a toddler of one or more years old who is no longer dependent on nipple inserts for feeding. This results in having the parents resort to numerous feeding bottles or drinking tops once the period is reached where the bottle is discarded. Further, taking an instance of travelling, the parents are required to not only bring drinking vessels they may need for themselves, but also the drinking vessels their baby needs. This causes inconvenience of carrying larger bags and multiple drinking vessels especially while transitioning from milk in a feeding bottle to other fluids in another Sippy cup. Therefore, a to-go drinking vessel is preferred during travel, since pouring the fluids out to another vessel will trigger the risk of spilling. It is therefore ideal to have a device that can be readily converted to a to-go style drinking vessel without the need of transferring the portion to another drinking device.

Many inventions have been made in this regard. But they either require a pre-arranged lid (US 20150008220), spout or bottle inserts (U.S. Pat. No. 4,994,076) for each of the container/vessel. They come in a unique size to fit a unique sized container/vessel without which they are of no use. Few attempted solutions have developed "a stretchable drinking lid" to fit a selective number of different sized containers/vessels (US 20130060224). Yet, such drinking tops are unproductive outside the set of selective different sized containers/vessels. Other existing universal silicone drinking tops have the drinking spout adaptors fixed to the vessel/container which ultimately renders a single function leaving the user again to purchase multiple spout adaptor such as silicone sippy spout adaptor, a separate silicone straw cup adaptor and so on. Besides, though the other available alternative drinking lids do provide flexibility to stretch over adult vessels, they lack the ability to accommodate different spout/nipples inserts easily within the lid without compromising the spill proof resistance of the overall vessel. The problem with most of the existing stretchable silicone lids for drinking vessels are that they lack the capability of allowing different model nipples or spout inserts to be inserted into the drinking vessel/container. They are further deficient providing an airtight stretchable lid that can convert any regular container/vessel such as a glass or cup into a preferred baby feeding vessel such as a baby bottle, a sippy cap or a straw cup, or a milk storage container by allowing different inserts to be mounted based on user preference without removing the lid.

Therefore, there is a long standing but unresolved need in the industry for a single drinking top cover having a stretchable material skin that not only extends over diverse types and sizes of drinking vessels/containers, but also allows diverse types of spout/nipples inserts to be easily secured to of be detached from the lid fathoming the need of different age group of users. There also exists a dire need in this field for a utility model which is more of a compact nature and provides a convenient solution to the of travelling with multiple feeding bottles and its corresponding multiple lids.

SUMMARY OF THE INVENTION

This summary is provided to introduce a selection of concepts in a simplified form that are further disclosed to the detailed description of the invention. This summary is not intended to identify key or essential inventive concepts of the claimed subject matter, nor is it intended for determining the scope of the claimed subject matter.

The multi-purpose stretchable insert mounting lid, disclosed herein, addresses the above-mentioned need in the industry for a single drinking top cover having a stretchable material skin that not only extends over diverse types and sixes of drinking vessels/containers, but also allows diverse types of spout/nipples inserts to be easily secured to or be detached from the lid fathoming the need of different age group of users. Moreover, the invention addresses the need for a utility model, which is more of a compact nature and provides a convenient solution to the fuss of travelling with multiple feeding bottles and its corresponding multiple lids. The present invention seeks to address the drawbacks associated with existing drinking spout adaptors. To achieve this purpose, the present invention discloses a spill proof, universal, multi-purpose stretchable insert mounting lid for drinking vessels that extends over any regular drinking vessel/container/receptacle and allows different prototypical nipples or spout inserts to be secured to the multi-purpose stretchable insert mounting lid. The disclosed model is novel in its functionality of being adapted conveniently to any regular drinking vessel-container and different type of bottle inserts. Further, the multi-purpose stretchable insert mounting lid is assembled to be a suitable feeding vessel for children in no time.

The working components utilized for this invention presides all the desirable attributes of a drinking vessel suitable for babies of all growing stages. Such desirable attributes without limitations, includes an airtight leak-proof seal around the drinking vessel/receptacle lip, adapted to extend over any regular drinking vessel/container/receptacle and further adaptable to let within different bottle inserts, and meets the feeding requirement of various developmental stages of babies. Further, the multi-purpose stretchable insert mounting lid is reusable and travel friendly due to its easy usage and non-necessitating need of carrying multiple feeding vessels and lids. The multi-purpose stretchable insert-mounting lid, disclosed herein, comprises a stretchable hollow body and a rigid ring member. The stretchable hollow body comprises a top opening, a bottom opening and a flexible sidewall. The flexible sidewall is configured to extend over sidewalls of a receptacle of one or more sizes. The top opening is configured to conform to an outlet of the receptacle. The rigid ring member is fixedly attached to an inner surface of the stretchable hollow body proximal to the top opening of the stretchable hollow body. Further, the rigid ring member is configured to restrain the stretchable hollow body against the receptacle. The rigid ring member comprises attachment elements configured to mount one or more insert elements for dispensing contents of the receptacle via the outlet.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DESCRIPTION OF THE PREFERRED EMBODIMENT

Figure 1A:
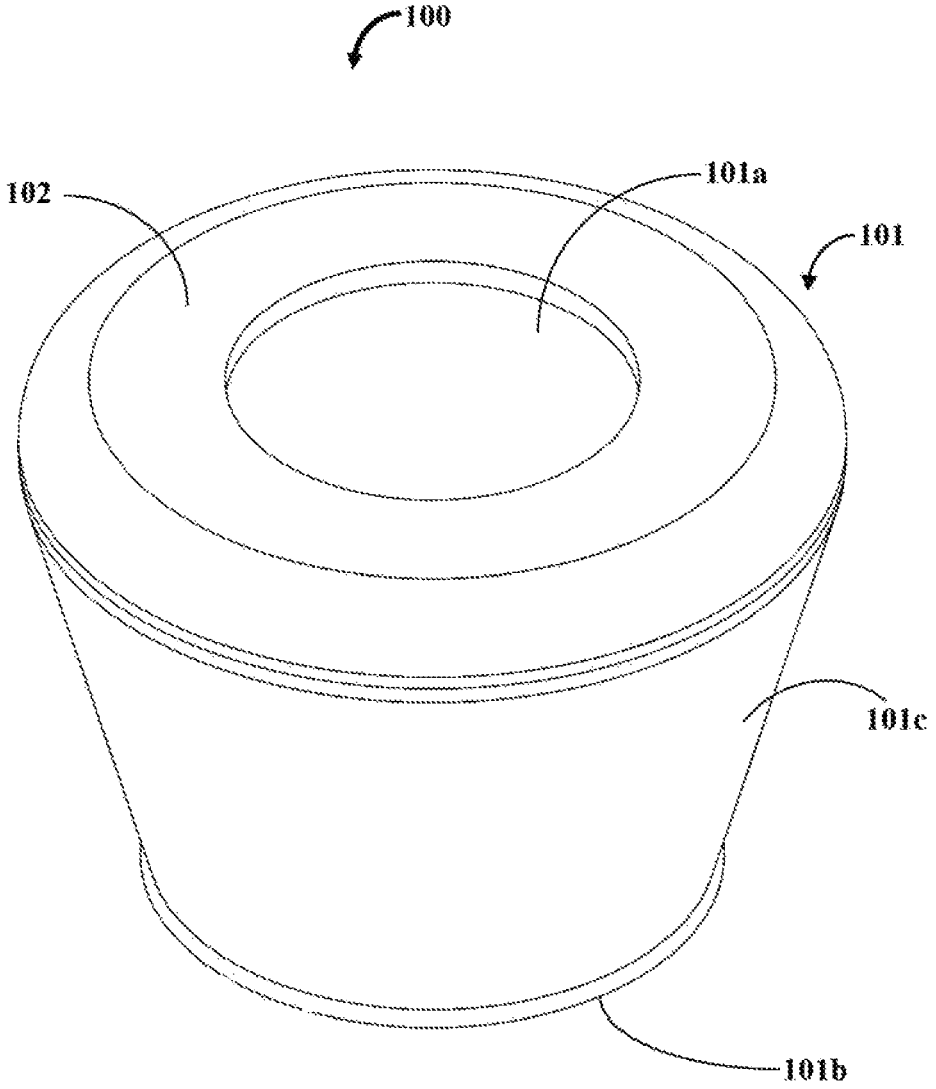
FIG. 1A exemplarily illustrates a top perspective view of a multi-purpose stretchable insert-mounting lid.
Figure 1B:
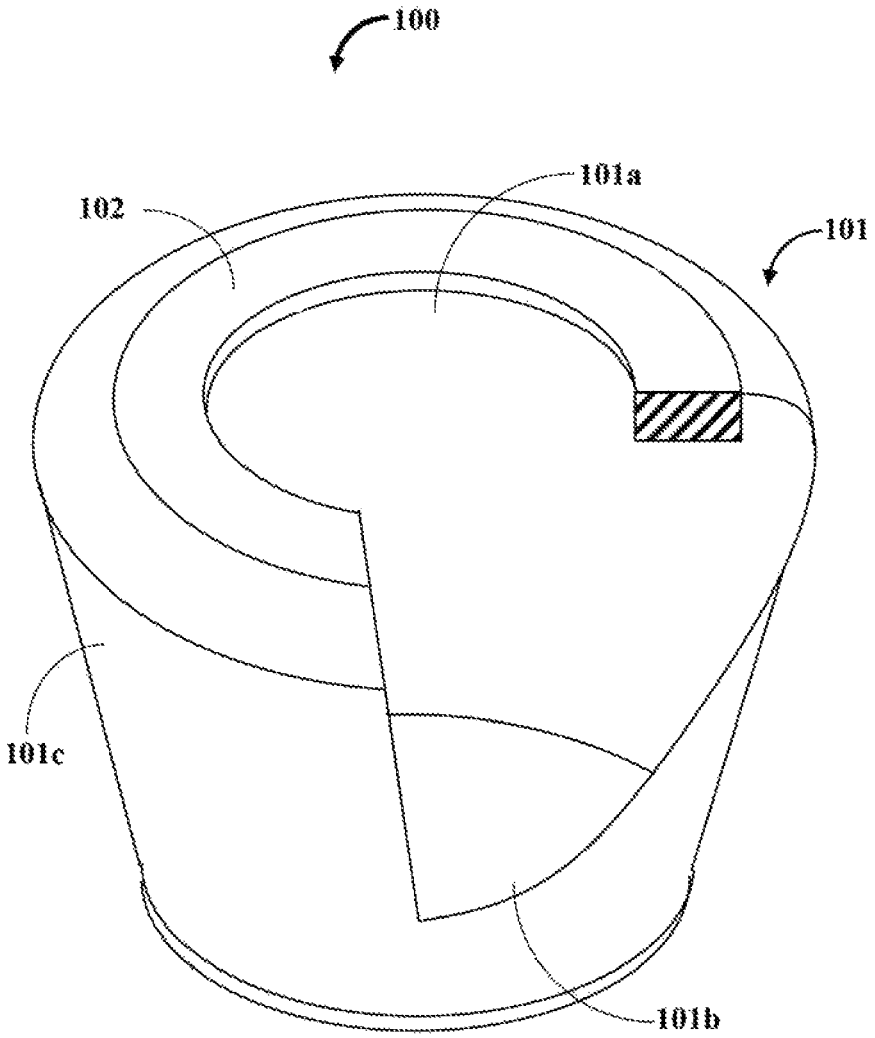
FIG. 1B exemplarily illustrates a cut away sectional elevation view of a multi-purpose stretchable insert-mounting lid.

FIG. 1A exemplarily illustrates a top perspective view of a multi-purpose stretchable insert-mounting lid 100. FIG. 1B exemplarily illustrates a cut away sectional elevation view of a multi-purpose stretchable insert-mounting lid 100. The main-purpose stretchable insert-mounting lid 100 comprises a stretchable hollow body 101 and a rigid ring member 102. The stretchable hollow-body 101 comprises a top opening 101*a*, a bottom opening 101*b*, and a flexible side wall 101*c*. The flexible side wall 101*c* is configured to extend over sidewalls of a receptacle of one or more sizes. The receptacle is, for example, a baby bottle, a cup, a jar, bowl, etc. The top opening 101*a* is configured to conform to an outlet of the receptacle. The rigid ring member 102 is fixedly attached to an inner surface proximal to the top opening 101*a* of the stretchable hollow body 101. The rigid ring member 102 is configured to restrain the stretchable hollow body 101 against the receptacle. The rigid ring member 102 comprises attachment elements 103, exemplarily illustrated in FIG. 2B. The attachment elements 103 are configured to mount one or more insert elements 104, exemplarily illustrated in FIG. 2B, for dispensing contents of the receptacle. The attachment elements 103 are, for example, a screw thread attachment, a channel support brace, etc. The insert elements 104 are, for example, a nipple insert, a straw tube insert, spout insert, etc.

In the preferred embodiment, the stretchable hollow body 101 of the multi-purpose stretchable insert-mounting lid 100 is made of a stretchable substance having flexible sidewall 101*c* forming a semi conical shape. In other embodiments, the multi-purpose stretchable insert-mounting lid 100 can be made in different geometrical configurations, for example, cylindrical, cuboidal, spherical, etc. The top opening 101*a* is provided as an inserting hole or a circular opening at the center of the top surface of the stretchable hollow body 101 of the multi-purpose stretchable insert-mounting lid 100. The rigid ring member 102 is fixedly attached beneath the circular top opening 101*a* forming a brace around the rim of the top opening 101*a*. The rigid ring member 102 has two functions. The first function is to restrain the stretchable hollow body 101 against the external sidewalls of the receptacle/container. The rigid ring member 102 prevents excess downward movement of the multi-purpose stretchable insert-mounting lid 100. Further, the rigid ring member 102 helps seat the multi-purpose stretchable insert-mounting lid 100 optimally on the receptacle/container. The second function of the rigid ring member 102 is to support or detachable mount the insert elements 104, exemplarily illustrated in FIG. 2B.

The multi-purpose stretchable insert-mounting lid 100 is composed of a substance having sufficient elasticity to retain the vessel/container closed firmly. The material of the multi-purpose stretchable insert-mounting lid 100 may include without limitation, silicone, rubber, or any other materials known to those ordinarily skilled in the art that provides for necessary elasticity and hygienic characteristics. In one embodiment, a silicone substance with a flexibility ranging between shore A 20 to shore A 40 may be used for the multi-purpose stretchable insert-mounting lid 100. The flexibility of the side-walls 101*c* of the multi-purpose stretchable insert-mounting lid 100 remains between 0.2 mm to 0.6 mm thick. The circular top opening 101*a* provided on the multi-purpose stretchable insert-mounting lid 100 is used for letting drinking insert elements 104, exemplarily illustrated in FIG. 2B, such as nipples or spouts, etc. to be inserted therewith. The circular top opening 101*a* is variable enough to adapt to regular sizes of different drinking insert elements 104 such as nipples, spouts, and straws, without the need of having multiple adaptors for such varied drinking insert elements 104.

The rigid ring member 102 is connected to the flexible sidewalls 101*c* of the multi-purpose stretchable insert-mounting lid 100. The rigid ring member 102 has thickness ranging between 1.5 mm and 2.5 mm and may be composed of materials selected from silicone (comparatively harder than the adapter cap), plastic or metal encased in a silicone envelope. In one example, the hardness of the rigid ring member 102 composed of silicone may lie between Shore A 70 to Shore A 100. In an embodiment, the rigid ring member 102 further comprises an attachment element 103, for example, a channel bracket, etc., to retain the drinking insert elements 104 as exemplarily illustrated in FIG. 2B.

Figure 2A:
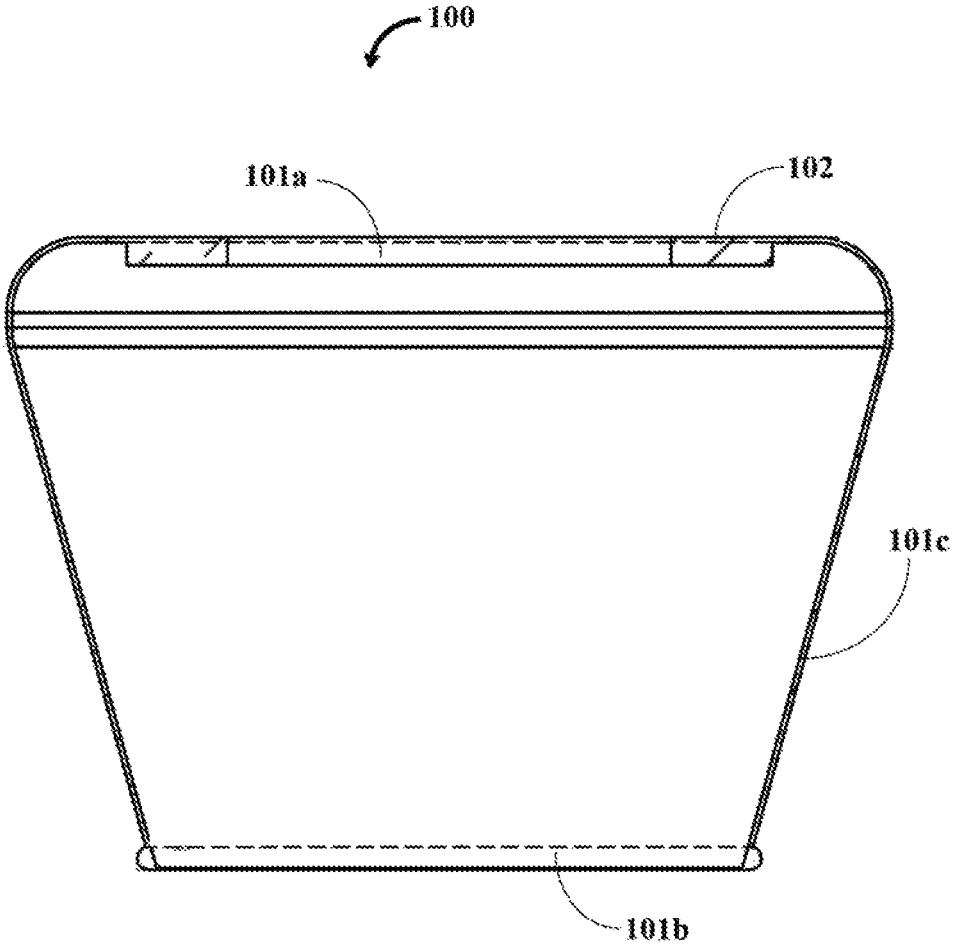
FIG. 2A exemplarily illustrates a front elevation view of a multi-purpose stretchable insert-mounting lid.
Figure 2B:
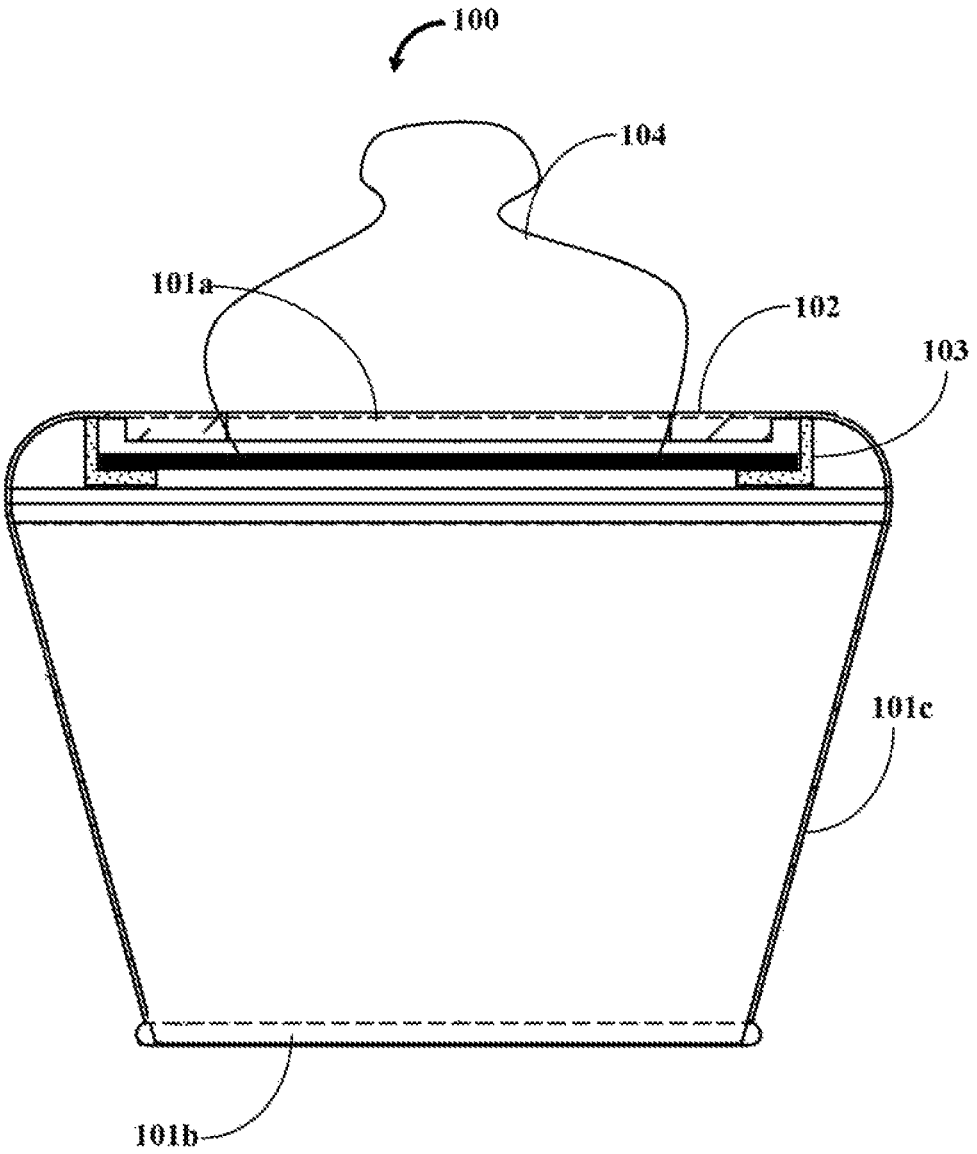
FIG. 2B exemplarily illustrates a front elevation view of a multi-purpose stretchable insert-mounting lid with a mounted insert element.

FIG. 2A exemplarily illustrates a front elevation view of a multi-purpose stretchable insert-mounting lid 100. FIG. 2B exemplarily illustrates a front elevation view of a multi-purpose stretchable insert-mounting lid 100 with a mounted insert element 104. The multi-purpose stretchable insert-mounting lid 100 for drinking vessels comprises a stretchable hollow body 101 having silicone side walls shaped in a semi conical configuration. The silicone walls are designed to be flexible ranging between shore A 20 to shore A 40. The stretchable hollow body 101 comprises a top opening 101*a* on the top surface of the semi cone circular opening. Running around the perimeter of the top opening 101*a* is a rigid ring member 102 made of a rigid material such as silicone at a hardness ranging between Shore A 70 to Shore A 100. The rigid ring member 102 is also made from plastic or metal and encased in a silicone envelope. The rigid ring member 102 is connected to the stretchable hollow body 101. The rigid ring member 102 forms a brace that holds the insert element 104 in place whilst the flexible silicone sidewalls 101*c* enable the multi-purpose stretchable insert-mounting lid 100 to encase the top of a drinking vessel/container holding the multi-purpose stretchable insert-mounting lid 100 securely to the drinking vessel.

In an embodiment, the rigid ring member 102 also includes an attachment element 103, for example, a channel support, etc., that further helps mount the insert element 104. The attachment element 103 is connected to the underside of the rigid ring member 102 and secures the insert element 104. In an embodiment, the attachment element 103 is also formed from the same rigid material as the rigid ring member 102 and is between 0.5 mm and 1 mm thick. In another embodiment, the multi-purpose stretchable insert-mounting lid 100 may also have a separate adaptor that enables distinct size insert elements 104, for example, silicone nipples to be inserted that are not the regular 35 mm diameter at the base. An attachment element 103, for example, an adaptor made from a rigid material fits inside the top opening 101*a* of the multi-purpose stretchable insert-mounting lid 100 making the top opening a smaller size to fit a standard neck nipple. A regular standard neck nipple is between 24 mm and 25 mm in diameter at the base. The adaptor may have different sized openings to allow different nipples from varied brands to be inserted. In another embodiment, the multi-purpose stretchable insert-mounting lid 100 may also have a separate adaptor that is rigid in its material property and encompasses an opening with a screw thread design.

The screw thread design allows for a cap to be screwed onto it but also allows different spoon and spout attachments to be screwed onto it as well as any other insert element 104 that may screw on. In another embodiment, the multi-purpose stretchable insert-mounting lid 100 may also incorporate a sealing disc as the insert element 104 that creates an airtight seal. The multi-purpose stretchable insert-mounting lid 100 may also incorporate a disc with a hole in the middle as the insert element 104 that can fit a conventional straw. The multi-purpose stretchable insert-mounting lid 100 may also be designed to be a larger size that can fit over bowls and incorporate a silicone insert with semi rigid flaps as the insert element 104 that retain food inside a vessel in case the vessel is tipped upside down. The flaps allow for small hands of a toddler to reach in and grab the food. Another embodiment of the multi-purpose stretchable insert-mounting lid 100 includes an opening on the flexible sidewalls 101*a* with a strap that enables the flexible sidewalls 101*a* to stretch over a cup that has a handle. After inserting the multi-purpose stretchable insert-mounting lid 100 over the cup the strap is secured in place.

In an embodiment, the multi-purpose stretchable insert-mounting lid 100 has a screw thread design medium. The screw thread design further allows for different spout, spoon, or other conceivable insert elements 104 to be tightly screwed onto it. For instance, the currently available spoon and spout with screw attachment that can instantly be screwed onto any enabling container. In another embodiment, the multi-purpose stretchable insert-mounting lid 100 may also be designed in enlarged size to stretch over containers having diameter comparatively greater than regular drinking bottles and containers.

The attachment element 103, for example, a channel support, etc., is co-molded together to the underside of the rigid ring member 102 forming a brace to secure the drinking insert elements 104. Unlike regular baby bottle collars which support the drinking insert elements 104 from the inner end of the collar of the lid in which it fits in, the multi-purpose stretchable insert-mounting lid 100 provides for an improved design of securing the drinking insert elements 104, wherein the edges of the drinking insert elements 104 are secured inside the attachment elements 103, for example, channel braces, etc., of the rigid ring member 102 beneath the top surface of the multi-purpose stretchable insert-mounting lid 100. The multi-purpose stretchable insert-mounting lid 100 on the other hand has the advantage of the described attachment elements 103, for example, channel support, etc., to bracket around the insert elements 104. The attachment elements 103 forming a part of the rigid ring member 102 have thickness ranging between 0.5 mm to 1 mm and are composed of the same rigid material of the rigid ring member 102.

The multi-purpose stretchable insert-mounting lid 100 is advantageous over other existing inventions as the multi-purpose stretchable insert-mounting lid 100 allows the user to insert various drinking insert elements 104 into one stretchable hollow body 101 unlike other flexible silicone lid inventions that have a fixed spout or outlet for drinking. The multi-purpose stretchable insert-mounting lid 100 also encompasses attachment elements 103, for example, channel supports, etc., that a regular baby bottle collar does not have. In a normal baby bottle the underside of the nipple or insert element 104 is supported by the top of the bottle. However, it is not the same in multi-purpose stretchable insert-mounting lid 100 because the top of the drinking vessel/receptacle doesn't normally line up with the underside of the nipple or other insert element 104. The attachment elements 103 of the multi-purpose stretchable insert-mounting lid 100 support the underside of the nipple, holding the nipple/insert element 104 securely in place. The multi-purpose stretchable insert-mounting lid 100 is used to turn a regular drinking vessel such as a glass or cup, into a baby feeding vessel such as a baby bottle, a sippy cup or a straw cup, or a milk storage container. This is done by combining the flexible sidewalls 101*c* being able to stretch over different sized drinking vessels, along with the circular top opening 101*a* that holds the insert element 104, for example, a drinking spout in place. The insert elements 104 include, for example, a nipple, a straw spout or a sippy spout, a cap, etc., that seals the vessel preventing any liquid from escaping (needed for travelling).

Figure 3A:
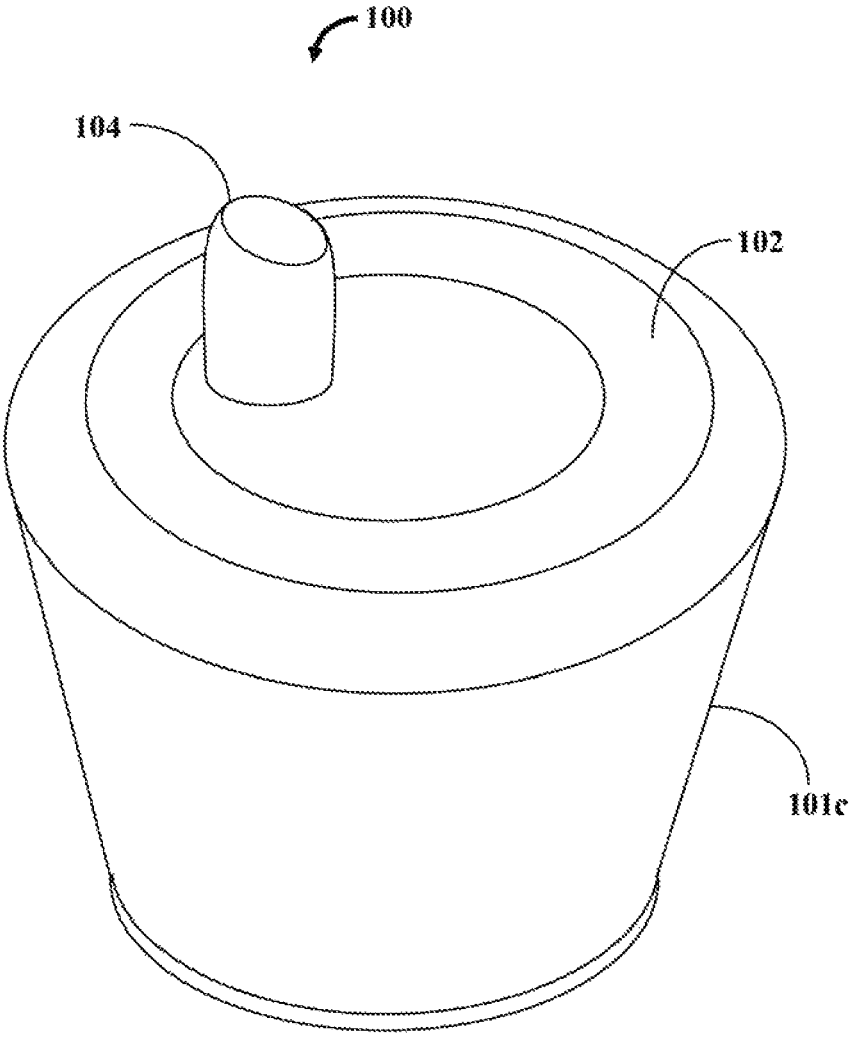
FIG. 3A exemplarily illustrates a perspective view of a multi-purpose stretchable insert-mounting lid with a spout as the mounted insert element.
Figure 3B:
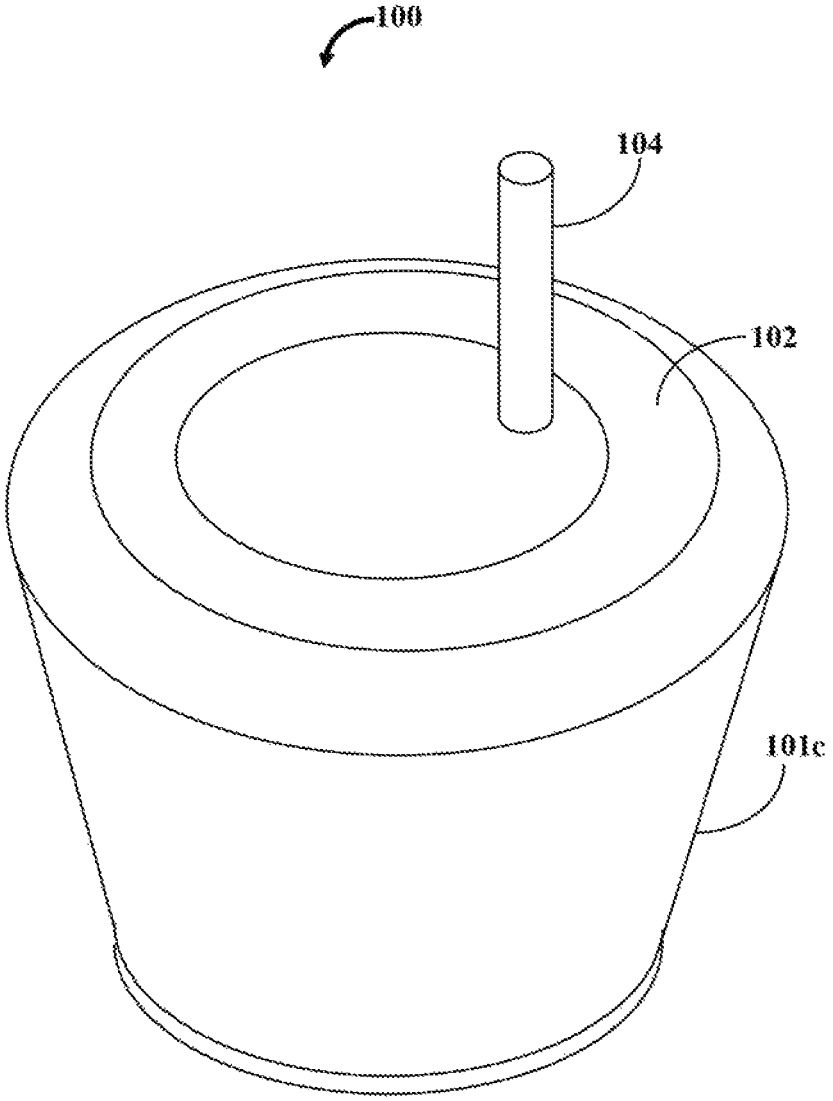
FIG. 3B exemplarily illustrates a perspective view of a multi-purpose stretchable insert-mounting lid with a straw as the mounted insert element.

FIG. 3A exemplarily illustrates a perspective view of a multi-purpose stretchable insert-mounting lid 100 with a spout as the mounted insert element 104. FIG. 3B exemplarily illustrates a perspective view of a multi-purpose stretchable insert-mounting lid 100 with a straw as the mounted insert element 104. The insert elements 104, for example, straw, spout, etc., are detachably attached to the rigid ring member 102 as exemplarily illustrated in FIGS. 3A-3B. Depending on the requirement of the user, the insert element 104, for example, spout may be removed and replaced by the straw. This is done without the removal of the stretchable hollow body. Once the stretchable hollow body of the multi-purpose stretchable insert-mounting lid 100 is installed on a vessel/receptacle/bowl/container, the user need only to mount the insert element 104 of choice. Several other attachments may be used as the insert element 104 depending on the preference and requirement of users.

Figure 3C:
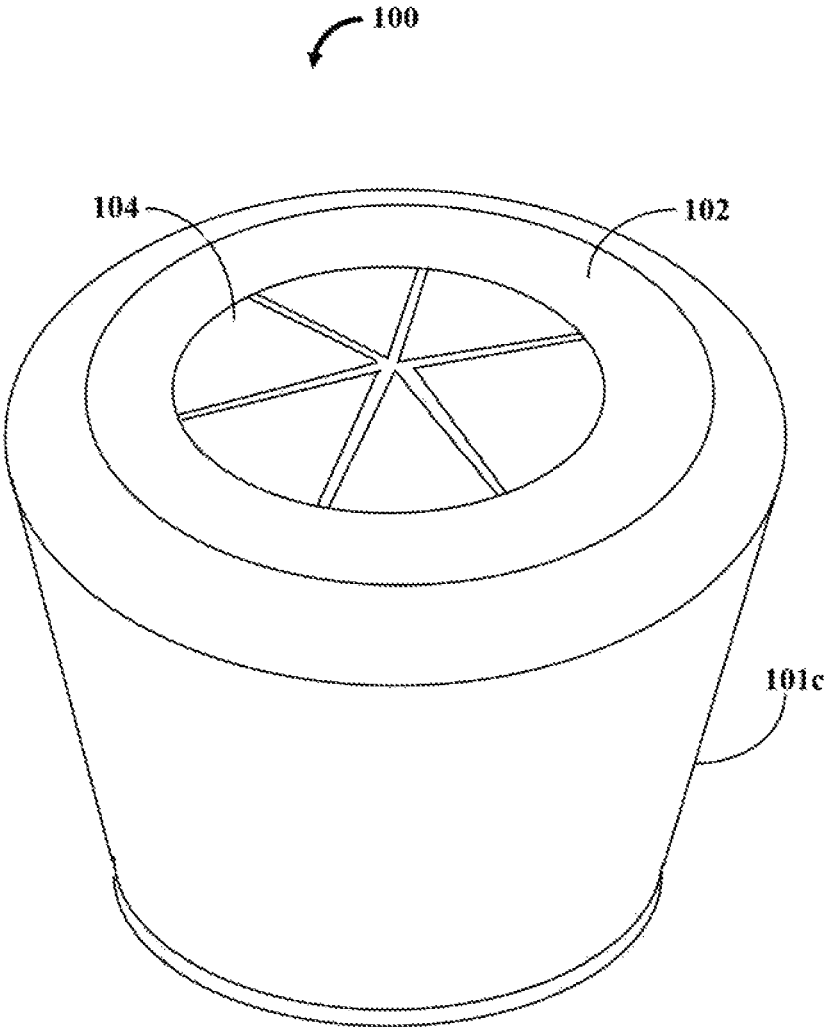
FIG. 3C exemplarily illustrates a perspective view of a multi-purpose stretchable insert-mounting lid with a snack trap as the mounted insert element.

FIG. 3C exemplarily illustrates a perspective view of a multi-purpose stretchable insert-mounting lid 100 with a snack trap as the mounted insert element 104. In the embodiment, the multi-purpose stretchable insert-mounting lid 100 is designed to be of a larger size that can fit over bowls. The snack trap is attached to the rigid ring member 102 as the insert element 104 to retain food inside a vessel in case the vessel is tipped upside down. The flaps of the snack trap allow for small hands of a toddler to reach in and grab the contents of the vessel as and when required.

The foregoing examples have been provided merely for the purpose of explanation and are in no way to be construed as limiting of the multi-purpose stretchable insert-mounting lid disclosed herein. While the multi-purpose stretchable insert-mounting lid 100 has been described with reference to various embodiments, it is understood that the words, which have been used herein, are words of description and illustration, rather than words of limitation. Further, although the multi-purpose stretchable insert-mounting lid 100 has been described herein with reference to particular means, materials, and embodiments, the multi-purpose stretchable insert-mounting lid 100 is not intended to be limited to the particulars disclosed herein; rather, the multi-purpose stretchable insert-mounting lid 100 extends to all functionally equivalent structures, methods and uses, such as are within the scope of the appended claims. Those skilled in the art, having the benefit of the teachings of this specification, may effect numerous modifications thereto and changes may be made without departing from the scope and spirit of the multi-purpose stretchable insert-mounting lid 100 disclosed herein in their aspects.

What is claimed is:

1. A multi-purpose stretchable insert mounting lid comprising:

stretchable hollow body comprising a top opening, a bottom opening, and a flexible sidewall, the flexible sidewall configured to extend over sidewalls of a receptacle of one or more sizes, wherein the top opening is configured to conform to an outlet of the receptacle;

a rigid ring member fixedly attached to an inner surface of the stretchable hollow body proximal to the top opening of the stretchable hollow body forming a brace around a rim of the top opening; and a channel bracket configured to detachably mount and retain one or more insert elements for dispensing contents of the receptacle;

Wherein the rigid ring member configured to restrain the stretchable hollow body against the receptacle when the stretchable hollow body is drawn downward over the side walls of the receptacle thereby creating an airtight seal between the stretchable hollow body and an external surface of the receptacle.

2. The multi-purpose stretchable insert mounting lid of claim 1, wherein the insert element is selected from the group consisting of a nipple, a spout, a sip tube, a straw tube, a snack trap, and a sealing disc.

3. The multi-purpose stretchable insert mounting lid of claim 1, wherein the stretchable hollow body is one of a cylindrical configuration, a cuboidal configuration, and a spherical configuration.

4. The multi-purpose stretchable insert mounting lid of claim 1, wherein the top opening of the stretchable hollow body is one of a circular shape and an oval shape.

5. The multi-purpose stretchable insert mounting lid of claim 1, wherein the rigid ring member is of one of a plastic material and a metallic material.

6. The multi-purpose stretchable insert mounting lid of claim 1, wherein the stretchable hollow body is of one of a silicone material and a rubber material.

* * * * *